US008985220B2

(12) United States Patent
Edwards

(10) Patent No.: US 8,985,220 B2
(45) Date of Patent: Mar. 24, 2015

(54) WELL INTERVENTION SYSTEM

(75) Inventor: Jeffrey Charles Edwards, Aberdeen (GB)

(73) Assignee: Enovate Systems Limited, Dyce, Aberdeen (GB)

( * ) Notice: Subject to any disclaimer, the term of this patent is extended or adjusted under 35 U.S.C. 154(b) by 599 days.

(21) Appl. No.: 12/666,244

(22) PCT Filed: Jun. 19, 2008

(86) PCT No.: PCT/GB2008/002086

§ 371 (c)(1), (2), (4) Date: Apr. 15, 2010

(87) PCT Pub. No.: WO2009/001036

PCT Pub. Date: Dec. 31, 2008

(65) Prior Publication Data

US 2010/0206574 A1 Aug. 19, 2010

(30) Foreign Application Priority Data

Jun. 25, 2007 (GB) ..... 0712226.0

(51) Int. Cl.

| | |
|---|---|
| ***E21B 17/01*** | (2006.01) |
| ***E21B 33/076*** | (2006.01) |
| ***E21B 19/00*** | (2006.01) |

(52) U.S. Cl.

CPC ..... *E21B 33/076* (2013.01); *E21B 17/01* (2013.01); *E21B 19/002* (2013.01)

USPC ..... 166/345; 166/355; 166/367; 166/350

(58) Field of Classification Search

CPC ..... E21B 19/006; E21B 17/017

USPC ..... 166/344, 345, 335, 350, 352, 355, 365, 166/367; 175/5, 7; 177/5, 7

See application file for complete search history.

(56) References Cited

U.S. PATENT DOCUMENTS

| | | | | |
|---|---|---|---|---|
| 3,817,325 | A * | 6/1974 | Mott et al. | 166/359 |
| 4,431,059 | A * | 2/1984 | Blenkarn et al. | 166/359 |
| 4,576,516 | A * | 3/1986 | Denison | 405/224.4 |
| 5,439,321 | A * | 8/1995 | Hunter | 405/195.1 |
| 6,129,151 | A | 10/2000 | Crotwell | |
| 2006/0021756 | A1 | 2/2006 | Bhat et al. | |
| 2006/0070741 | A1 | 4/2006 | Pollack et al. | |
| 2006/0196672 | A1 | 9/2006 | Robichaux | |
| 2006/0219411 | A1 * | 10/2006 | Moksvold | 166/345 |

FOREIGN PATENT DOCUMENTS

| | | | | |
|---|---|---|---|---|
| GB | 2 250 767 | A | 6/1992 | |
| GB | 2 311 545 | A | 10/1997 | |
| GB | 2 334 049 | A | 8/1999 | |
| GB | 2 362 667 | A | 11/2001 | |
| GB | 2 412 130 | A | 9/2005 | |
| GB | 2423544 | | 8/2006 | |
| WO | WO-2005/100737 | A1 | 10/2005 | |
| WO | WO 2005100737 | A1 * | 10/2005 | E21B 19/22 |
| WO | 2007044924 | | 4/2007 | |

* cited by examiner

*Primary Examiner* — James G Sayre

(74) *Attorney, Agent, or Firm* — Tarolli, Sundheim, Covell & Tummino LLP

(57) ABSTRACT

A well intervention system is described which has a riser access drive adapted to be located below a vessel, or a rig, work floor. The riser is tensioned and extends from a subsea wellhead to the access device which, in use, is attached to the riser at the location below the work floor. Embodiments of the invention are described.

40 Claims, 9 Drawing Sheets

WELL INTERVENTION SYSTEM

FIELD OF THE INVENTION

The present invention relates to an improved well intervention system.

BACKGROUND TO THE INVENTION

Risers are widely used with subsea oil wells. A riser is a tubular attached at one end to a wellhead on the seabed and at the other end to a floating rig or a boat on the surface. The riser passes through a hole in the rig floor or the deck of the boat, and is topped by a riser access device, which may incorporate valves, to allow fluids to enter or leave the well, or plugs or the like.

The riser must be maintained in tension to prevent it from collapsing, and tension is applied to the riser by tensioners which extend from the vessel and attach to the riser at a location beneath the vessel deck or floor. The tensioners are generally cables which pay out and reel in as the vessel moves due to the heave of the sea, maintaining a constant tension on the riser, and maintaining the vertical position of the access device fixed relative to the seabed. As the access device is fixed relative to the seabed, and to compensate for the rise and fall of the vessel, the access device is located at a considerable height above the vessel, to prevent the riser access device impacting on the floor or deck of the vessel.

However, when is necessary for an operator access to the riser, it is undesirable for the access device to be moving relative to the vessel floor or deck; instead it is preferable for the access device to remain stationary relative to the vessel. To make this possible, a slip joint is provided between the access device and the point at which the tensioners attach to the riser. The slip joint accommodates the heave of the sea permitting the access device to be lowered to the deck or floor. To maintain the riser in tension when access is not required, a compensator applies a lifting force to the access device sufficient to extend the slip joint to the maximum extent of its travel.

The compensator can apply the lifting force to the access device through a lifting frame which may be provided above the access device to permit equipment such as injector valves to be attached to the access device or to allow tool strings to be lowered through the access device into the riser.

Conventional riser systems have a number of drawbacks. For example, the slip joint can be unreliable and can only be safely utilized when depressurised as they are subject to a pressure end load effect. When the slip joint is depressurised the surface isolation valves cannot be utilised and if there is any leakage past the primary downhole well isolation device both personnel on the vessel and the vessel itself can be exposed to hydrocarbons from the well and the associated consequential risk.

Furthermore, in rough seas or in dynamic positioning mode it can be difficult to maintain the position of the vessel directly over the subsea wellhead. Deviation from this position applies a bending moment to the riser, which can result, in some cases, in the vessel having to detach from the wellhead to avoid catastrophic failure. To accommodate the movement of the vessel, the surface equipment has to placed a considerable height above the vessel floor or deck to avoid it impacting with the vessel floor as the vessel moves off location due to the increased distance between the vessel and the well.

There are also safety issues associated with accessing the riser from above the flowhead. The elevated positioning of the flowhead and the lifting frame requires high level working on a platform which is moving in relation to the vessel floor or deck to introduce tools or equipment into the riser.

A further area of concern is during operation, the compensator system, which applies a tension to the riser through the surface equipment, such as the lifting frame, has been known to over-tension the riser causing the riser to fail with catastrophic consequences.

An object of at least one embodiment of the present invention is to obviate or mitigate at least one of the disadvantages of the aforementioned well intervention systems.

SUMMARY OF THE INVENTION

According to a first aspect of the present invention there is provided a well intervention system for intervening in a subsea well, the well intervention system comprising:

a riser access device adapted to be located below a vessel work floor; and a riser adapted to be tensioned and extend from a subsea wellhead to the access device;

wherein, in use, the riser access device is attached to the riser at a location below the vessel work floor.

In one embodiment of the present invention, the well intervention system provides an arrangement which substantially removes the need for high level working to, for example, introduce a tool string into the riser. As the riser access device is located, in use, below the vessel work floor, operators can assemble the tool and lower the tool into the riser from the level of the work floor.

For the avoidance of doubt by "vessel" it is meant any rig, ship, boat, buoy or other vessel suitable for performing drilling or well intervention operations and by "work floor" it is meant the deck or floor of the vessel from where operators execute well intervention operations.

Preferably, the riser access device is releasably attachable to the riser.

Preferably, the riser access device is attachable by means of a latch.

Preferably, the riser access device is sealably attachable to the riser. In one embodiment the riser access device can form a seal sufficient to contain the pressure within the riser. The seal may be sufficient to seal the riser from the external environment.

The riser access device may comprise a number of valves including one or more of a flow valve (for removing fluid from the well), a kill valve (for injecting fluid into the well), and a master valve for isolating the well.

Preferably, in use, the riser is tensioned from the vessel.

Preferably, the well intervention system comprises at least one tensioning device for tensioning the riser.

Preferably, in use, the at least one tensioning device extends from the vessel.

Preferably, the/each tensioning device is attached to the riser.

Preferably, the/each tensioning device is releasably attachable to the riser.

Preferably, the riser further comprises at least one attachment point.

Preferably, the/each tensioning device is attached to the riser at an attachment point.

Preferably, the riser access device is located adjacent the/each attachment point.

Preferably, the riser access device is located above the/each attachment point. Locating the riser access device above and adjacent the/each attachment point obviates the need for a slip joint between the attachment point(s) and the riser access device.

Alternatively or additionally, the/each tensioning device is attached to the riser access device.

In one embodiment, the tensioning devices are tensioning devices found on rigs or boats suitable for performing drilling or well intervention operations.

Alternatively or additionally, the riser is tensioned from a second riser.

Preferably, the riser is inside the second riser.

In another embodiment, a compensator system is attached to the riser access device.

Preferably, the compensator system is attached to the riser access device by means of a lifting bridle.

Alternatively or additionally, the compensator system is attached to the riser access device by means of a running tool.

Preferably, the riser has a fixed length.

Preferably, the well intervention system includes at least one flexible member adapted to extend from the riser access device to the vessel. Utilising flexible members to extend from the riser access device to the vessel reduces the effects of movement of the vessel with respect to the wellhead on the seabed.

Preferably, at least one of the flexible members is in fluid communication with the riser.

Preferably, at least one of the flexible members is adapted to receive fluid from the riser.

Alternatively or additionally, at least one of the flexible members is adapted to present fluid to the riser. Utilising flexible members to carry fluids to and from the riser prevents the vessel applying a bending moment to the riser as the vessel moves with respect to the wellhead on the seabed.

Alternatively or additionally, at least one of the flexible members comprises a control line. A control line can be provided to send control signals to tools in the riser.

Preferably, the riser access device is adapted to be connected, in use, to an apparatus located on or above the vessel work floor.

Preferably, in use, the riser access device is connected to the apparatus by means of a variable length tubular. A variable length tubular is useful if the material may have to be contained, such as coiled tubing for example, is to be passed from the apparatus down to the riser access device. It is preferred to contain coiled tubing as a sudden movement of the vessel towards the riser access device could cause coiled tubing between the vessel and the riser access device to buckle.

In one embodiment the riser comprises an open water riser.

In an alternative embodiment the riser comprises a marine riser and a well entry riser.

In this embodiment, the riser access device is attached to the well entry riser.

Preferably, at least one tensioning device is attached to the marine riser.

Preferably, the well entry riser is tensioned by engagement with the marine riser.

Preferably, tensioning apparatus is provided to apply a substantially constant tension to the well entry riser.

Preferably, the tensioning apparatus is engaged with the marine riser.

Preferably, the tensioning apparatus is as described in the applicant's co-pending patent application GB 0613393.8.

According to a second aspect of the present invention there is provided a method of intervening in a well, the method comprising the steps of:

attaching a tensioned riser suspended from a vessel to a subsea wellhead; and accessing the top of the riser through a riser access device located below the vessel work floor.

According to a third aspect of the present invention there is provided a well intervention system for intervening in a subsea well, the well intervention system comprising:

a riser access device;

a tensioned riser adapted to extend from a subsea wellhead to the access device; and a vessel having a vessel work floor;

wherein the riser access device is attached to the riser at a location below the vessel work floor.

Preferably, the vessel work floor defines an aperture adapted to permit the riser access device to pass therethrough. Such an arrangement permits the riser access device to be raised from or lowered onto the riser.

BRIEF DESCRIPTION OF THE DRAWINGS

Embodiments of the present invention will now be described with reference to the accompanying drawings in which.

DETAILED DESCRIPTION OF THE DRAWINGS

Figure 1:
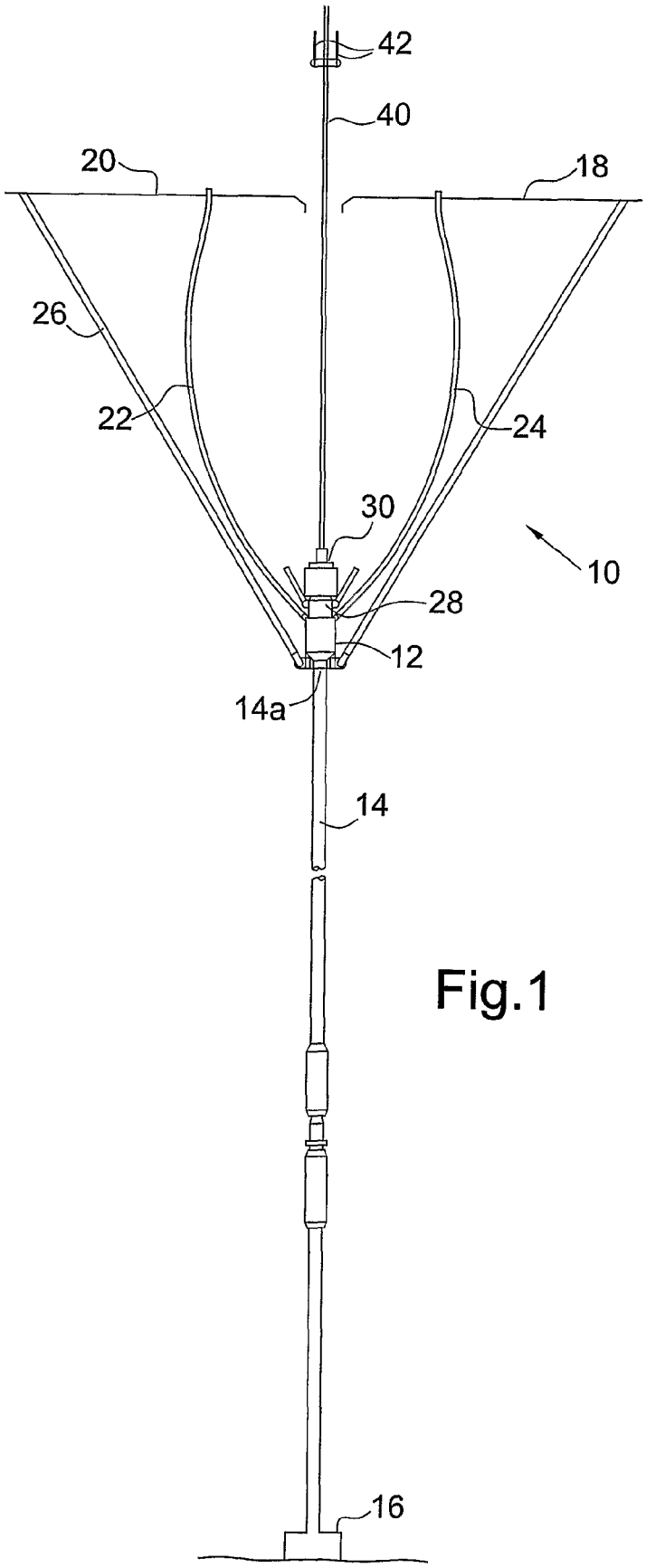
FIG. 1 is a schematic view of a well intervention system according to a first embodiment of the present invention.

Reference is firstly made to FIG. 1 a schematic view of a well intervention system generally indicated by reference numeral 10, according to a first embodiment of the present invention. The well intervention system 10 comprises a riser access device 12, a tensioned open water riser 14 extending between a subsea wellhead 16 and the riser access device 12 and a vessel 18. The vessel 18 is a floating platform of which only the work floor 20, from which well intervention operations are performed, is shown for clarity.

As can be seen from FIG. 1, the riser access device 12 is attached to the top 14*a* of the open water riser 14 at a location below the work floor 20. Such an arrangement removes the need for high level working to introduce, for example, a tool string into the open water riser 14, as will be described in detail later.

Attached to the riser access device 12 are a flexible flow line 22 and a flexible kill line 24. The open water riser 14 is kept in tension by tensioning cables 26 are connected between the work floor 20 and the top 14*a* of the riser 14. As the connections between the riser access device 12 and the work floor 20, that is the flow and kill lines 22,24 and the tensioning cables 26, are all flexible, then deviation of the vessel 18 from directly above the subsea wellhead 16 results in a limited bending moment being applied to the riser 14.

A flexible lifting bridle 40 is attached to a vessel-mounted compensator system 42, to raise and lower a running tool 30 into engagement with the riser access device 12. As the lifting bridle 40 is flexible, movement of the vessel 18 from directly above the subsea wellhead 16 results in a minimal bending moment being applied to the riser 14.

The riser access device 12 further includes a master valve 28 for shutting the riser 14 quickly in the event of an emergency. The master valve 28 seals a production tube (not shown), housed within the open water riser 14, from the running tool 30 and the flow and kill lines 22, 24. In addition, the master valve 28 is adapted to sever any intervention equipment such as tooling, wire line or coiled tubing passing through the valve 28. Various well intervention operations can be performed within the open water riser 14 using the system of FIG. 1. Examples of these operations will now be discussed with reference to the following Figures.

Figure 2:
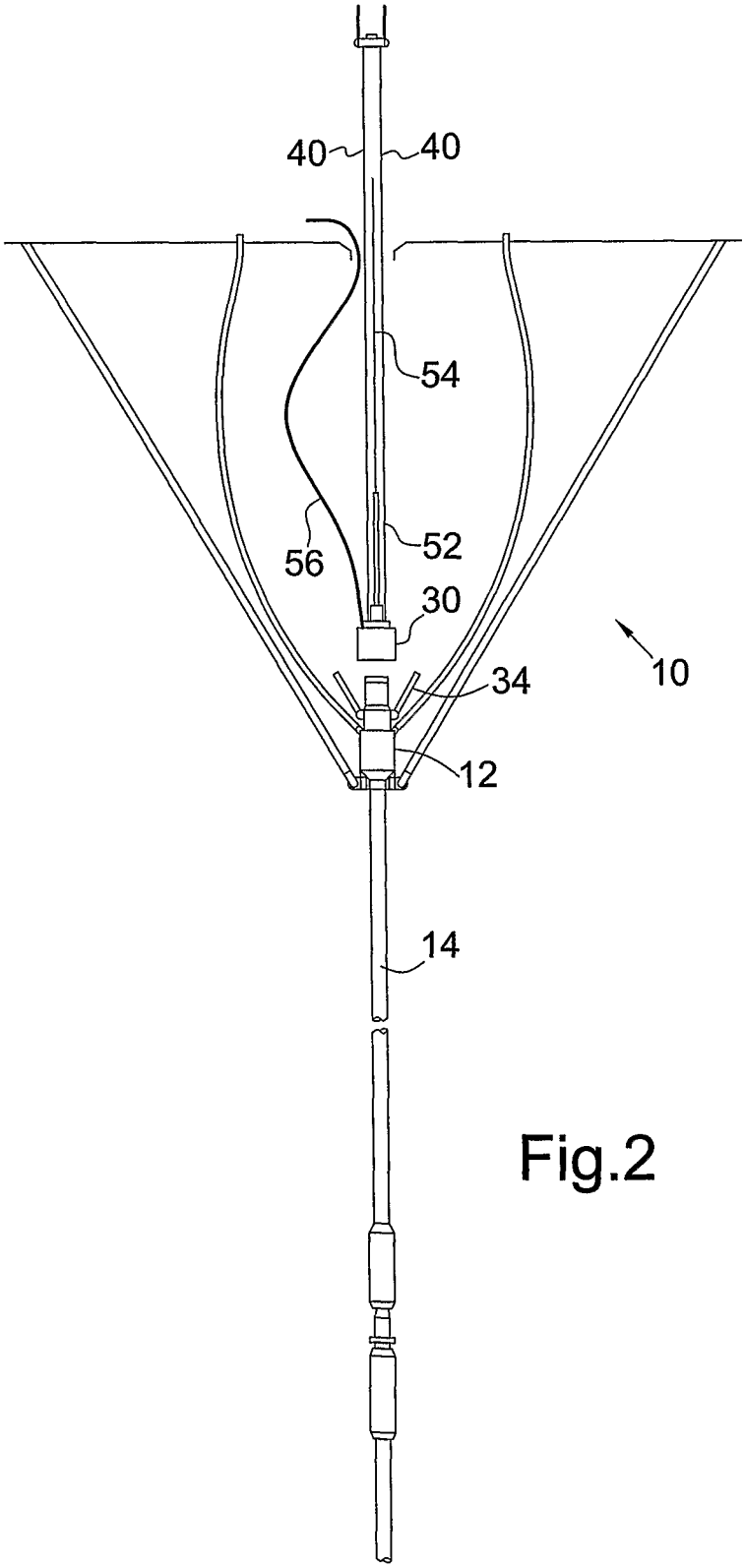
FIG. 2 is a schematic view of the well intervention system of FIG. 1 shown with a running tool and a wireline pack-off system, with the running tool disconnected from the riser access device.

Referring now to FIG. 2, there is shown a schematic view of the well intervention system of FIG. 1 with a running tool 30 and a wireline pack-off system 52, with the running tool 30 disconnected. The wireline pack-off system 52 is mounted to the running tool 30, and provides a conduit through which wireline 54 can be fed into the open water riser 14. The running tool 30 and wireline pack-off system 52 are lowered on to the riser access device 12 by the lifting bridle 40. A guide 34 is provided to assist in locating the running tool 30 on the riser access device 12. A flexible umbilical 56 is provided to control the functions of the wireline pack-off system 52 and running tool 30. An additional umbilical (not shown) controls the functions of the riser access device 12.

Figure 3:
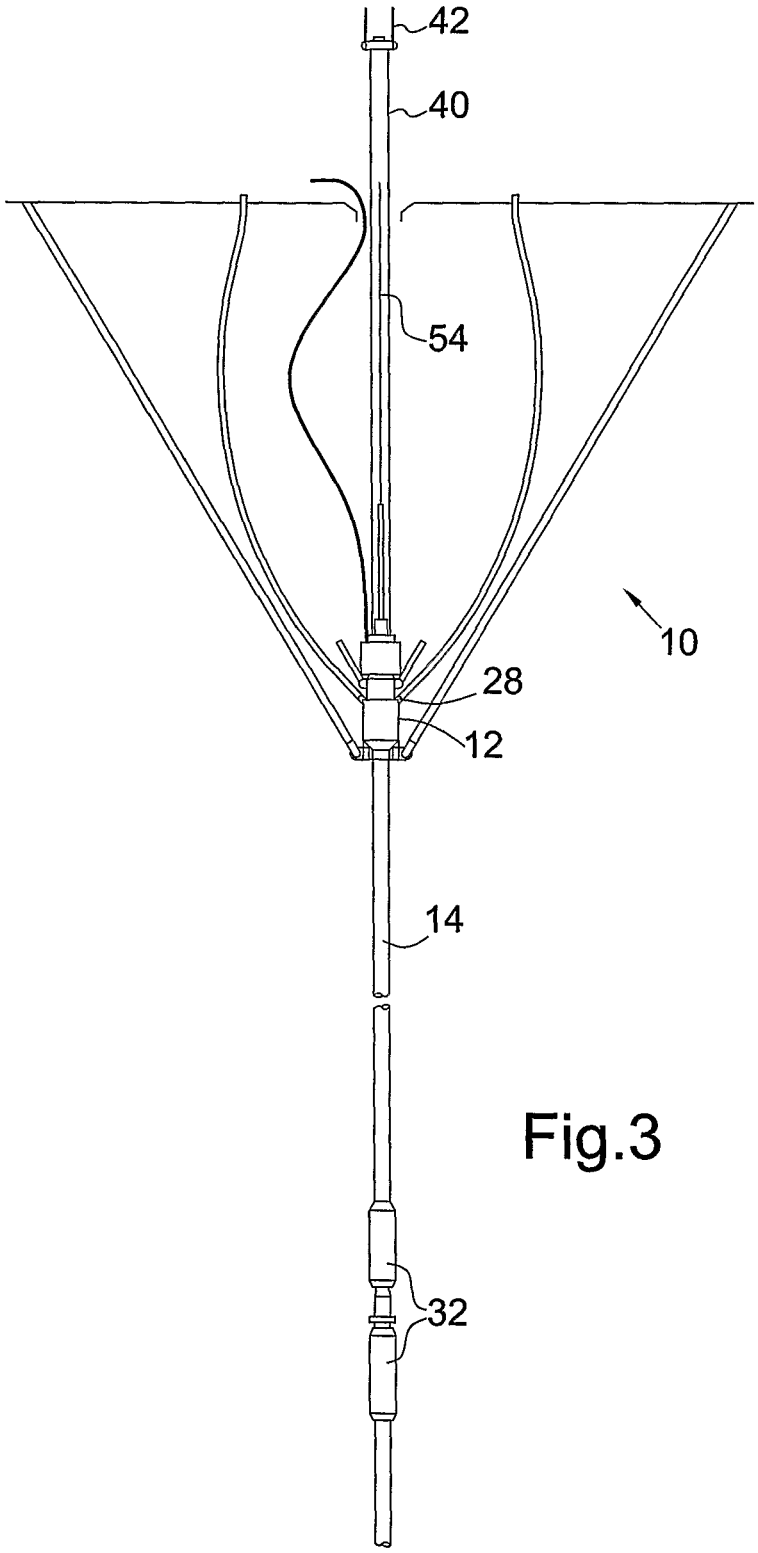
FIG. 3 is a schematic view of the well intervention system of FIG. 2 with the running tool connected to the riser access device.

Referring to FIG. 3, there is shown a schematic view of the well intervention system 10 of FIG. 1 with the running tool 30 connected to the riser access device 12. The open water riser 14 is provided with a lubricator valve system 32. When closed, the section of riser 14 between the riser access device 12 and the lubricator valve system 32 is isolated from well and can be depressurised. The master valve 28 can now be opened permitting access to the open water riser 14. The wireline tooling (not shown) can then be assembled and lowered into the riser 14. Once the wireline pack-off system 52 and the running tool 34 are connected to the riser access device 12, the pressure integrity of the well intervention system 10 can be confirmed by hydrostatically testing the system 10 against the lubricator valve system 32 once the integrity of the upper section of riser 14 and riser access device 12 have been confirmed, the lubricator valve system 32 can be opened and the wireline 54 with associated tooling can be lowered into the lower part of the riser 14 and the well by the wireline pack-off system 52.

Figure 4:
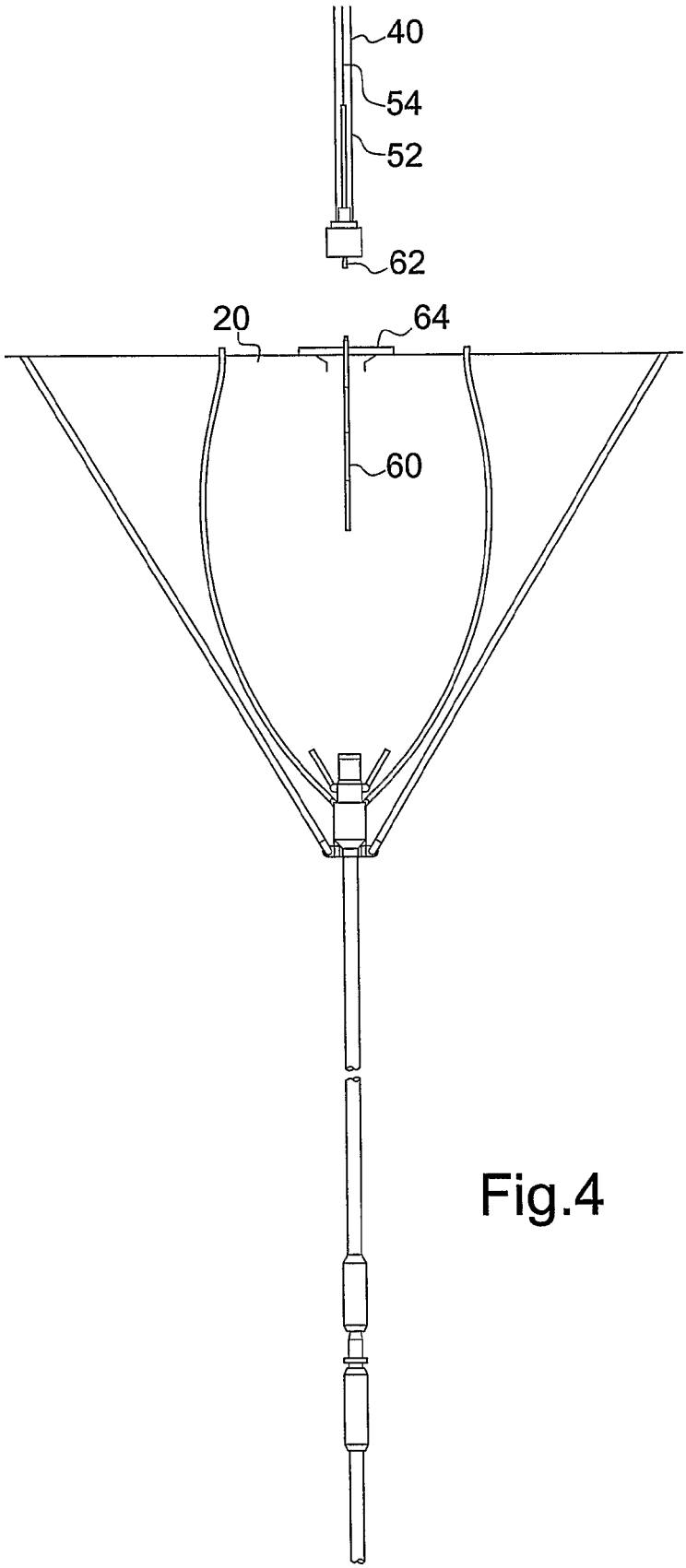
FIG. 4 is a schematic view of the well intervention system of FIG. 1 shown with a running tool, a wireline pack-off system, and a tool string with the pack-off system shown above the work floor.

Referring now to FIG. 4, there is shown a schematic view of the well intervention system of FIG. 1 shown with a running tool 30, a wireline pack-off system 52, and a tool string 60. As can be seen from FIG. 4, a latch connector 62 is provided at the end of the wireline 54 and the pack-off system 52 is raised above the work floor 20 so the tool string 60 can be assembled at the level of the work floor 20 without the need for high level working. A bushing plate 64 mounted to the work floor 20 enables sections of the wireline tool string 60 to be suspended from the work floor 20, facilitating assembly of the tool string 60. Once assembled the latch connector 62 is connected to the top of the tool string 60. The bushing plate 64 is then removed and the running tool 30, wireline pack-off 52 and the tool string 60 are lowered through the work floor 20 and the tool string 60 is fed into the open water riser 14 as described with reference to FIGS. 2 and 3.

Figure 5:
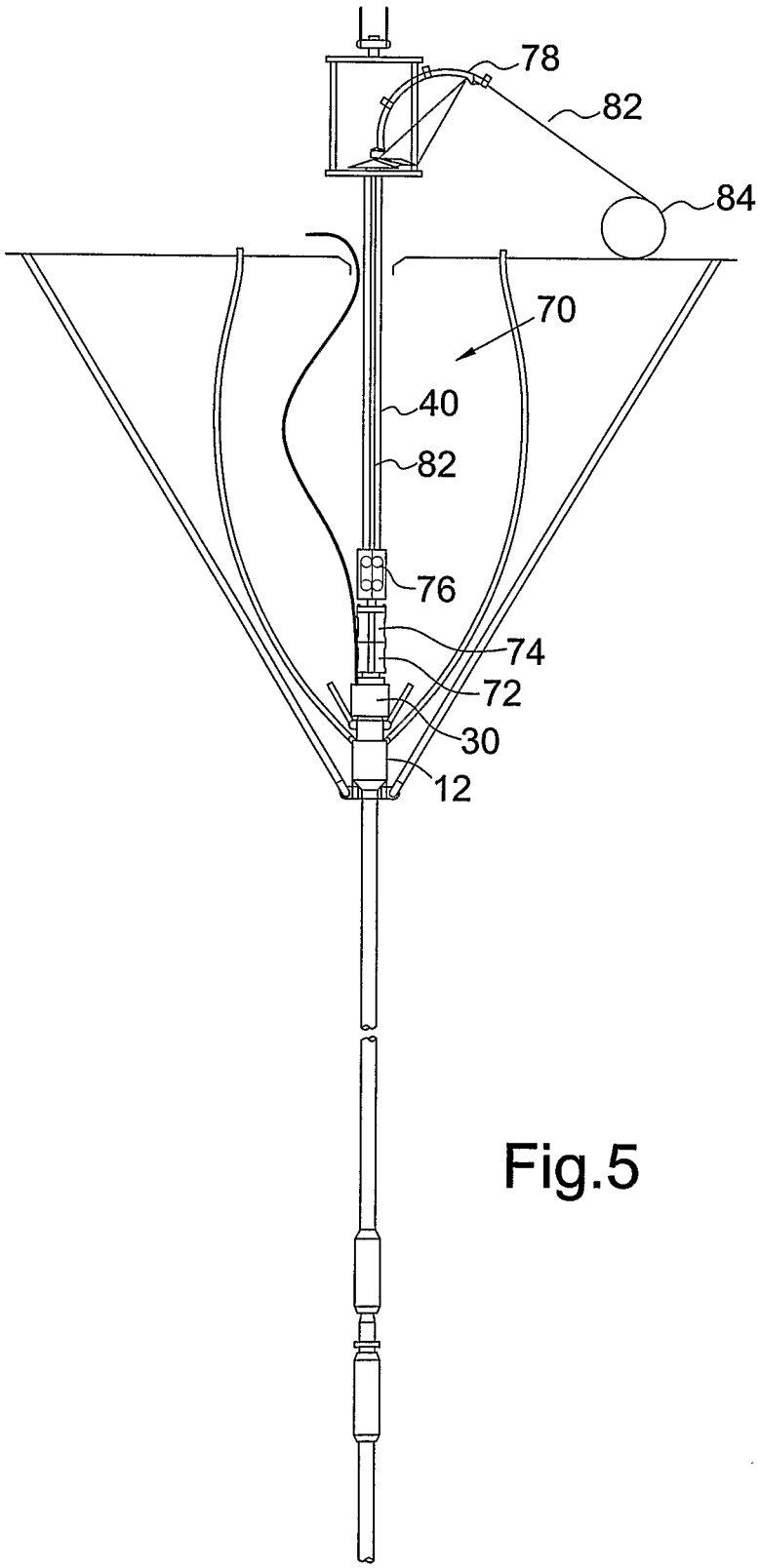
FIG. 5 is a schematic view of the well intervention system of FIG. 1 shown with a coiled tubing feed system.

The well intervention system 10 of the present invention is also suitable for use with coiled tubing. Referring to FIG. 5, there is shown a schematic view of the well intervention system of FIG. 1 shown with a coiled tubing feed system 70. The coiled tubing feed system 70 comprises a grip/seal BOP 72, a shear/seal BOP 74, a coiled tubing injector head 76 and a gooseneck 78. Coiled tubing 82 is fed to the gooseneck 78 from a drum 84 which is mounted to the vessel deck 20. The drum 84 pays out or reels in the coiled tubing 82 at a speed which accommodates the sea heave.

Figure 6:
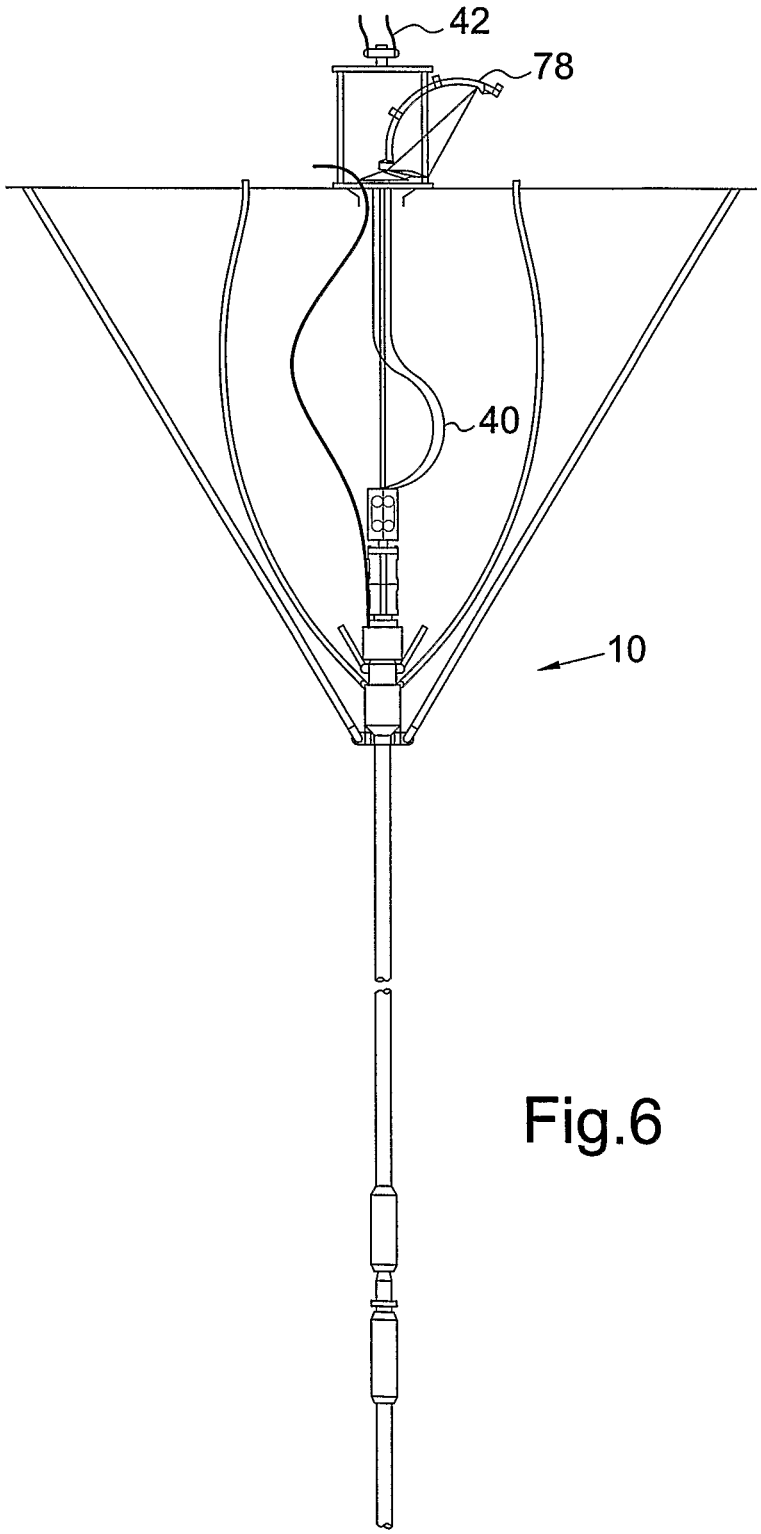
FIG. 6 is a schematic view of the well intervention system of FIG. 5 with the gooseneck lowered.

The BOPs 72,74 and the injector head 76 are attached to the running tool 30 and are lowered into engagement with the riser access device 12 by the lifting bridle 40. Once in position the goose head 78 can be lowered on to the work floor 20 (FIG. 6). When this happens the tension of the lifting bridle 40 and the compensator cables 42 is relaxed and, as they are flexible, they adopt a relaxed or non-tensioned appearance as shown in FIG. 6.

Figure 7:
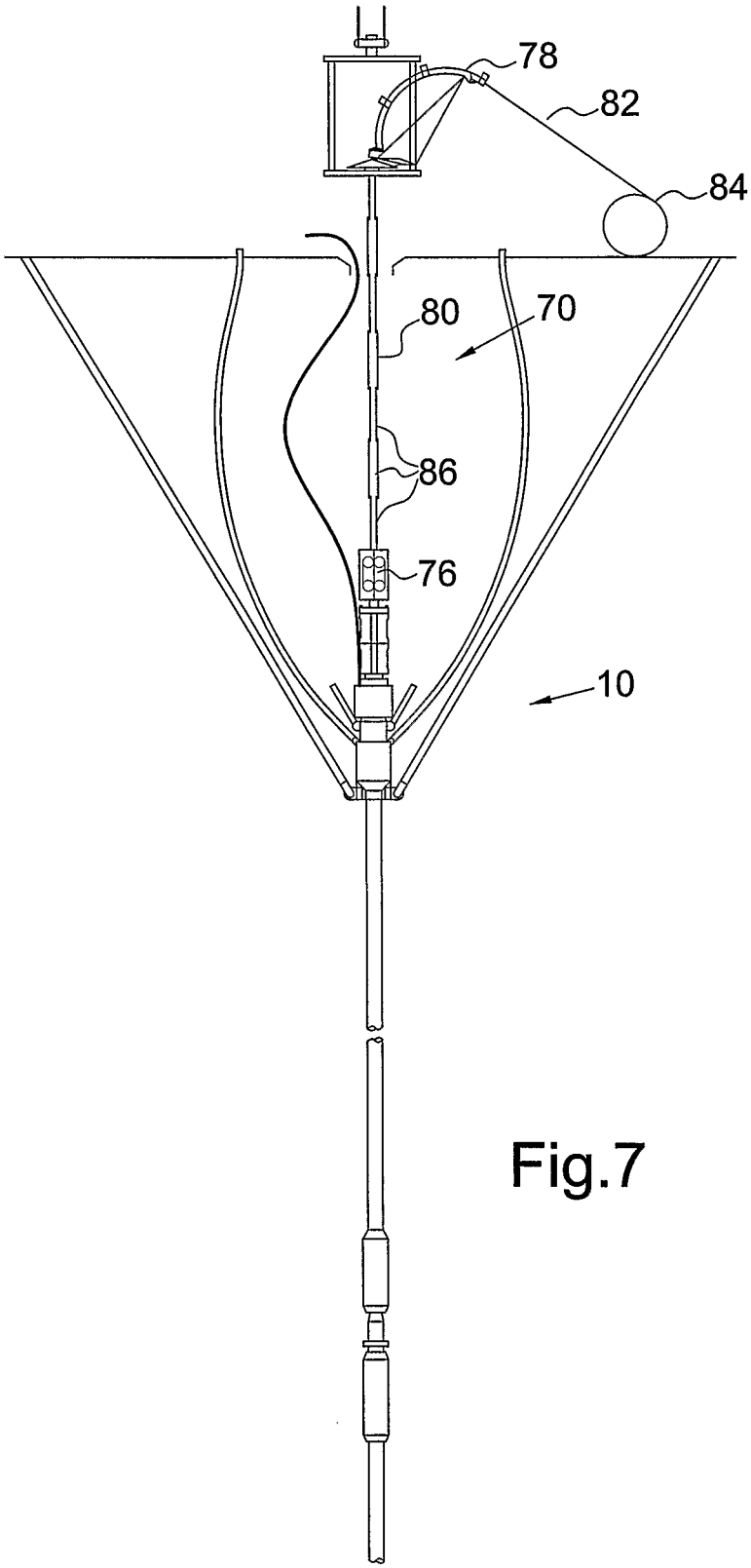
FIG. 7 is a schematic view of the well intervention system of FIG. 1 shown with an alternative coiled tubing feed system.

Referring now to FIG. 7, there is shown a schematic view of the well intervention system of FIG. 1 but with an alternative coiled tubing feed system 70. In this system 70, the lifting bridle has been replaced with a variable length telescopic tubular 80. The variable length tubular 80 comprises a number of telescopically arranged tubing sections 86. As the sea level rises and falls the variable length tubular accommodates the change by the tubular sections telescoping with respect to each other. The variable length tubular 80 is provided to support the coiled tubing and prevent it from buckling. A tendency for the coiled tubing to buckle may occur if, for example, there is a significant sea heave. In this circumstance, the drum 84 may not be able to accommodate the rapid increase in sea level, and the coiled tubing between the gooseneck 78 and the injector head 76 may be subject to a compressive, buckling force. In this situation, the variable length tubular restricts the movement of the coiled tubing and prevents it from buckling.

Figure 8:
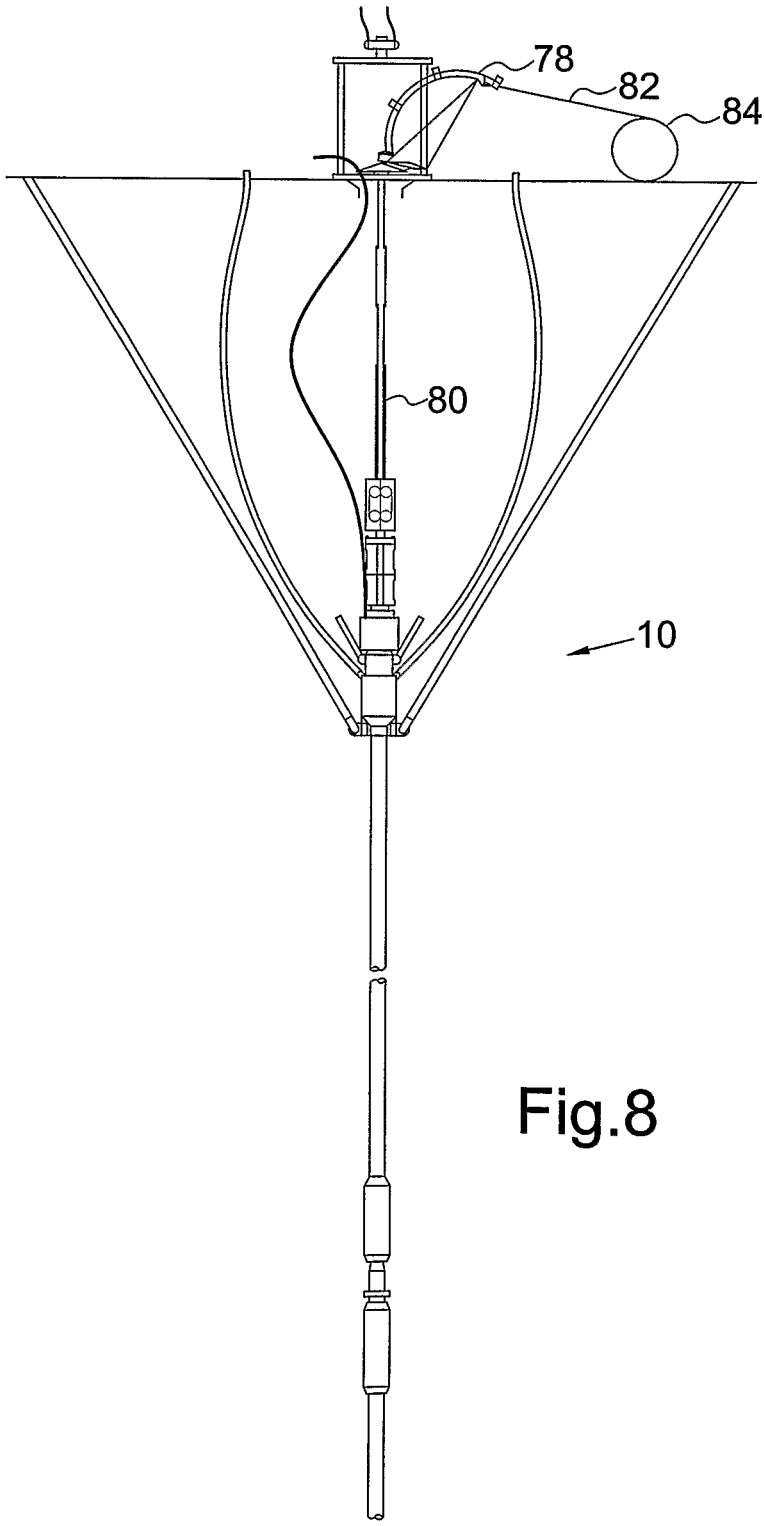
FIG. 8 is a schematic view of the well intervention system of FIG. 7 with the gooseneck lowered.

The telescopic variable length tubular 84 also permits the gooseneck to be lowered to the deck 20 prior to use (FIG. 8).

Figure 9:
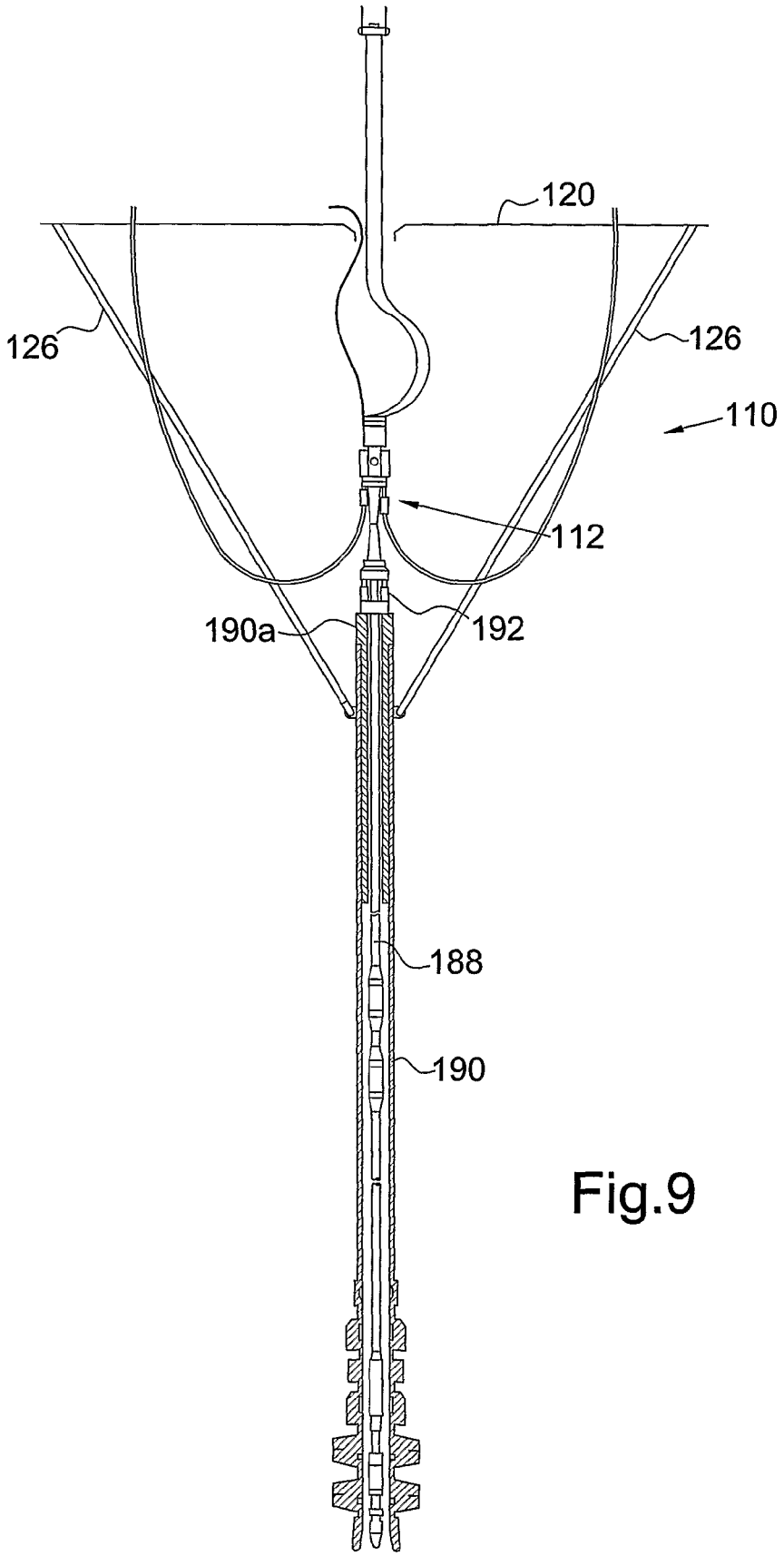
FIG. 9 is a schematic view of a well intervention system according to a second embodiment of the present invention.

Reference is now made to FIG. 9, a schematic view of a well intervention system 110 according to a second embodiment of the present invention. Features in common between the first and second embodiments are given the same numeral in the second embodiment as the first incremented by 100.

The well intervention system 110 of FIG. 9 includes a well entry riser 188 which runs inside a marine riser 190. As can be seen the riser access device 112 is attached to the well entry riser 188 at a location below the work floor 120.

The marine riser 190 is kept in tension by tensioning cables 126 which extend between the work floor 120 and the top of the riser 190*a*. The well entry riser 188 is tensioned off the marine riser 190 by a telescopic tensioning device 192 of the type disclosed in the applicants co-pending United Kingdom application number GB 0613393.8. An example of the tensioning device 192 is sold by Enovate Systems Limited under the brand name EN-TENSE™.

The tensioning device 192 has a first portion (not shown) coupled to the well entry riser 188, a second portion (not shown) coupled to the marine riser 190 and a hydraulic fluid supply (not shown) providing relative movement between the first portion and the second portion to tension the well entry riser 188.

Various modifications and improvements may be made to the above-described embodiments without departing from the scope of the invention. For example, although the vessel of the described embodiments is a floating platform, the system of the present invention could be used with a boat or other vessel suitable for performing well interventions.

The invention claimed is:

1. A well intervention system for intervening in a subsea well, the well intervention system comprising:

a riser access device adapted to be located below a vessel work floor;

a riser adapted to extend from a subsea wellhead to the access device; and at least one tensioning device for tensioning the riser wherein, in use, the at least one tensioning device extends from a vessel and is attached to the riser; and at least one flexible member in fluid communication with the riser, the at least one flexible member adapted to extend from the riser access device to the vessel, such that deviation of the vessel from directly above the subsea wellhead results in a minimal bending moment being applied to the riser, wherein, in use, the riser access device is attached to the riser at a location below the vessel work floor.

2. The well intervention system of claim 1, wherein the riser access device is releasably attachable to the riser.

3. The well intervention system of claim 1, wherein the riser access device comprises a master valve for isolating the well.

4. The well intervention system of claim 1 wherein the/each tensioning device is releasably attachable to the riser.

5. The well intervention system of claim 1, wherein the riser further comprises at least one attachment point.

6. The well intervention system of claim 5, wherein the/each tensioning device is attached to the riser at an attachment point.

7. The well intervention system of claim 5, wherein the riser access device is located adjacent the/each attachment point.

8. The well intervention system of claim 5, wherein the riser access device is located above the/each attachment point.

9. The well intervention system of claim 1, wherein the/each tensioning device is attached to The riser access device.

10. The well intervention system of claim 1, wherein the tensioning devices are tensioning devices found on rigs or boats suitable for performing drilling or well intervention operations.

11. The well intervention system of claim 1, wherein the riser is tensioned from a second riser.

12. The well intervention system of claim 11, wherein the riser is inside the second riser.

13. The well intervention system of claim 1, wherein a compensator system is attached to the riser access device.

14. The well intervention system of claim 13, wherein the compensator system is attached to the riser access device by means of a lifting bridle.

15. The well intervention system of claim 13, wherein the compensator system is attached to the riser access device by means of a running tool.

16. The well intervention system of claim 1, wherein the riser has a fixed length.

17. The well intervention system of claim 1, wherein at least one of the flexible members is adapted to receive fluid from the riser.

18. The well intervention system of claim 1, wherein at least one of the flexible members is adapted to present fluid to the riser.

19. The well intervention system of claim 1, wherein at least one of the flexible members comprises a control line.

20. The well intervention system of claim 1, wherein the riser access device is adapted to be connected, in use, to an apparatus located on or above the vessel work floor.

21. The well intervention system of claim 20, wherein, in use, the riser access device is connected to the apparatus by means of a variable length tubular.

22. The well intervention system of claim 1, wherein the riser comprises an open water riser.

23. The well intervention system of claim 1, wherein the riser comprises a marine riser and a well entry riser.

24. The well intervention system of claim 23, wherein the riser access device is attached to the well entry riser.

25. The well intervention system of claim 23, wherein at least one tensioning device is attached to the marine riser.

26. The well intervention system of claim 23, wherein the well entry riser is tensioned by engagement with the marine riser.

27. The well intervention system of claim 23, wherein the tensioning apparatus is provided to apply a substantially constant tension to the well entry riser.

28. The well intervention system of claim 27, wherein the tensioning apparatus is engaged with the marine riser 29. The well intervention system of claim 1, wherein the at least one tensioning device biases the riser in a direction extending towards the vessel.

30. The well intervention system of claim 1, wherein the at least one tensioning device is secured to the riser at a location between the riser access device and the subsea wellhead.

31. The well intervention system of claim 1, wherein the riser terminates at the riser access device at a location below the vessel work floor.

32. A method of intervening in a well, the method comprising the steps of:

attaching a tensioned riser suspended from a vessel to a subsea wellhead, wherein the riser is tensioned by at least one tensioning device extending, in use, from the vessel and being attached to the riser; and accessing the top of the riser through a riser access device located below a work floor of the vessel, wherein at least one flexible member is adapted to extend from the riser access device to the vessel, the at least one flexible member being in fluid communication with the riser, such that deviation of the vessel from directly above the subsea wellhead results in a minimal bending moment being applied to the riser.

33. The method of claim 32, wherein tensioning the riser with the at least one tensioning device biases the riser in a direction extending towards the vessel.

34. The method of claim 32 further comprising attaching the at least one tensioning device to the riser at a position below and adjacent to the riser access device.

35. The method of claim 32, wherein the riser terminates at the riser access device at a location below the vessel work floor 36. A well intervention system for intervening in a subsea well, the well intervention system comprising:

a riser access device;

a tensioned riser adapted to extend from a subsea wellhead to the access device;

a vessel having a vessel work floor; and at least one tensioning device for tensioning the riser wherein, in use, the at least one tensioning device extends from the vessel and is attached to the riser; and at least one flexible member in fluid communication with the riser, the at least one flexible member adapted to extend from the riser access device to the vessel, such that deviation of the vessel from directly above the subsea wellhead results in a minimal bending moment being applied to the riser, wherein the riser access device is attached to the riser a location below the vessel work floor.

37. The well intervention system of claim 36, wherein the vessel work floor defines an aperture adapted to permit the riser access device to pass therethrough.

38. The well intervention system of claim 36, wherein the at least one tensioning device biases the riser in a direction extending towards the vessel.

39. The well intervention system of claim 36, wherein the at least one tensioning device is attached to the riser at a position below and adjacent to the riser access device.

40. The well intervention system of claim 36, wherein the riser terminates at the riser access device at a location below the vessel work floor.

* * * * *